US006668389B1

(12) United States Patent
Steinmetz et al.

(10) Patent No.: US 6,668,389 B1
(45) Date of Patent: Dec. 30, 2003

(54) VACUUM TOILET

(75) Inventors: Uwe-Michael Steinmetz, Wiesbaden (DE); Karlheinz Steinmüller, Alzey (DE); Thomas Dittmar, Wiesbaden (DE); Steffen Zang, Aschaffenburg (DE)

(73) Assignee: Lufthansa Technik AG, Hamburg (DE)

( * ) Notice: Subject to any disclaimer, the term of this patent is extended or adjusted under 35 U.S.C. 154(b) by 0 days.

(21) Appl. No.: 09/711,371

(22) Filed: Nov. 10, 2000

(30) Foreign Application Priority Data

Nov. 11, 1999 (EP) ..... 99122519

(51) Int. Cl.[7] ..... E03D 11/00; E03D 9/00
(52) U.S. Cl. ..... 4/256.1; 4/255.01
(58) Field of Search ..... 4/256.1, 255.01, 4/420, 431–433; 138/40, 44; 210/162

(56) References Cited

U.S. PATENT DOCUMENTS 563,397 A * 7/1896 Morrison ..... 4/256.1 X
864,196 A * 8/1907 Rollins ..... 4/420
883,896 A * 4/1908 Lyons ..... 4/420
1,759,574 A 5/1930 Hollenweger
2,506,669 A * 5/1950 Heuacker ..... 4/292
2,693,603 A * 11/1954 Lehmann ..... 4/256.1
4,521,925 A 6/1985 Chen et al.
4,555,818 A * 12/1985 Harrington ..... 4/256.1
5,117,862 A * 6/1992 Molligan ..... 4/256.1 X
5,283,913 A * 2/1994 Jaeckels ..... 4/420
5,829,471 A 11/1998 Hofseth

FOREIGN PATENT DOCUMENTS

DE 9884 6/1880
EP 0 379 643 A1 8/1990

* cited by examiner

*Primary Examiner*—Charles E. Phillips
(74) *Attorney, Agent, or Firm*—Akin, Gump, Strauss, Hauer & Feld, L.L.P.

(57) ABSTRACT

A vacuum toilet comprises a toilet bowl (1) and a vacuum pipeline (3) which opens out into said toilet bowl. In the region of the opening (2), the vacuum line (3) has a cross-sectional narrowing in the form of a foreign-body barrier (5) which projects radially into the line interior. Alternatively provided is an insert pipe part (6) which can be inserted into the vacuum pipeline (3) in the region of the opening (2) and has an above-described foreign-body barrier (5).

20 Claims, 2 Drawing Sheets

VACUUM TOILET

BACKGROUND OF THE INVENTION

The invention relates to a vacuum toilet, as is used, for example, in aircraft and in railway carriages, having a toilet bowl and a vacuum pipeline which opens out into said toilet bowl.

During operation of such vacuum toilets, it is often the case that passengers drop foreign bodies, such as powder compacts, cosmetics articles, combs, spectacles, and the like, into the toilet bowl. Once the vacuum flushing has been initiated, these objects are carried away by suction and may result in blockages in the toilet pipe system, which may adversely affect, or prevent altogether, the continued operation of the vacuum flushing. Such an operational breakdown can often only be rectified by the pipeline system being removed in part in order for the foreign body to be found. This is time-consuming and costly and usually cannot be carried out during the flight or journey, which may result in lengthy and thus disruptive breakdown times. The blockage of the vacuum system by foreign bodies is often all the more serious since it is usually the case that a number of toilets are connected to a single vacuum system, for which reason a number of toilets are put out of action at the same time by a single foreign body.

BRIEF SUMMARY OF THE INVENTION

An object of the invention is to avoid long-term blockages of such a vacuum system by foreign bodies. This object is achieved in that, in the region of the opening of the vacuum pipeline into the toilet bowl, the vacuum pipeline has a cross-sectional narrowing in the form of a foreign-body barrier which projects radially into the line interior. An alternative embodiment of the invention provides an insert pipe part which can be inserted into the vacuum pipeline in the region of the opening, the insert part having a cross-sectional narrowing in the form of a foreign-body barrier which projects radially into the pipe interior.

First of all, the following will better explain and define some of the terms which are essential to an understanding of the invention. The term "pipeline" or "pipe part", rather than being restricted to lines of round cross section, covers all conceivable shapes and cross sections (e.g., oval or elliptical) and also covers pipeline arrangements which have different shaping and different dimensions in certain areas. The radial direction is the direction predetermined by the gradient of the flow speed. It is thus oriented perpendicularly to the flow direction and in the direction of the geometrical pipe central axis.

The term "flow" relates, in this context, to the flushing fluid which is carried away by suction. The alignment of the foreign-body barrier in the radially inward direction also covers those embodiments which, in addition to the radial component, also have a component in the flow direction or a cross-sectionally tangential component, and which are thus oriented axially or laterally obliquely in the inward direction.

The term "cross-sectional narrowing" relates to the diameter of cylindrical bodies which can still just pass freely through the pipeline. For example, with a line diameter of 50 mm, a cross-sectional narrowing of 20% means that cylindrical elements with a diameter of 40 mm can still pass the foreign-body barrier freely, while those with diameters larger than 40 mm remain caught on the foreign-body barrier. The cross-sectional narrowing should be distinguished from a reduction in the cross-sectional area of the pipeline. In the example mentioned, the 20% cross-sectional narrowing could be brought about by a thin inwardly projecting bar of 10 mm in length, although this would barely reduce the free cross-sectional area.

As a result of the cross-sectional narrowing according to the invention, any foreign bodies which have passed into the toilet bowl and, on account of their dimensions, would be sucked into the vacuum system without obstruction, if there were no foreign-body barrier, remain caught on the foreign-body barrier. The foreign-body barrier has to be sufficiently rigid in order to be able to withstand impact and contact pressure exerted by foreign bodies. Arranging the foreign-body barrier in the region of the opening of the vacuum line into the toilet bowl ensures that the foreign bodies are intercepted directly in the region of the opening and, in any case, only a single toilet is affected. Furthermore, this region is easily accessible from the outside, with the result that a foreign body remaining caught on the foreign-body barrier can be removed again very quickly, as a result of which lengthy breakdown times are avoided.

By virtue of a foreign-body barrier which projects radially into the line interior, correct normal operation of the vacuum toilet, in contrast, for example, to a lattice-like barrier, is not obstructed since the feces material is compressible and is carried away past the foreign-body barrier by suction-possibly being compressed in the process. Should, in exceptional cases, the foreign-body barrier be blocked by feces, then, by virtue of the foreign-body barrier being arranged in the region of the opening of the vacuum pipeline, the blockage, in any case, is easily accessible and can be released quickly, for example with the aid of a customarily provided cleaning brush.

Within the context of the invention, the foreign-body barrier is arranged in the region of the opening of the vacuum pipeline, whereby a foreign body which remains caught on the barrier can be removed again, by way of the opening of the vacuum pipeline in the toilet bowl, without the pipeline system having to be dismantled for this purpose. If appropriate, it is also possible for the insert pipe part to be removed, together with the foreign body held fast therein, cleaned and reinserted.

An insert pipe part according to the invention, which is insertable into the vacuum pipeline and has a cross-sectional narrowing in the form of a foreign-body barrier projecting radially into the pipe interior, makes it possible for existing vacuum toilets in aircraft and railway carriages to be retrofitted without additional structural changes to the toilets themselves. In this case, the foreign-body barrier is arranged in the tubular insert part, which can be inserted into the vacuum pipeline in the region of the opening of the same into the toilet bowl. If appropriate, locking may be provided between the insert pipe part and vacuum line.

The foreign-body barrier is preferably configured such that the cross-sectional narrowing brought about by it is more than 10%, preferably more than 20%, more preferably approximately 30%, of the line diameter. The preferred radial narrowing of 30% of the line diameter is based on the fact, on the one hand, that the narrowing has to be of a sufficient size in order to be as effective as possible in keeping out foreign bodies of different sizes and, on the other hand, that the foreign-body barrier must not project radially inwards to too great an extent, since otherwise the risk of blockage during correct operation increases.

In a preferred embodiment, the cross-sectional narrowing which is brought about by the foreign-body barrier is adapted approximately to the smallest clear cross section of the rest of the pipeline system. If there are narrowed locations in the rest of the pipeline system (for example upstream of the feces tank) which could be blocked by cylindrical bodies with a cross-sectional diameter greater than d, then the maximum radial narrowing of the foreign-body barrier is to be accordingly dimensioned such that it cannot have cylinders with diameter d passing it any longer. This means, on the one hand, that objects which can pass the foreign-body barrier can also pass reliably through the rest of the pipeline system; at the same time, the maximum radial narrowing is no larger than necessary, in order for correct operation not to be threatened by blockages. This embodiment is preferred, in particular, when the internal diameter of the vacuum lines decreases, for example in the direction of the feces tank, rather than being constant over the entire pipeline system between the vacuum toilet and feces tank.

The circumferential length of the foreign-body barrier is advantageously 10–50%, preferably 20–40%, more preferably approximately 25%, of the line circumference. Both the circumferential length of the foreign-body barrier and the line circumference relate here to the inner surface of the pipeline wall and/or of the insert pipe part. On the one hand, the circumferential length of the foreign-body barrier should not be selected to be too small, because a small circumferential length means a foreign-body barrier shape which projects inwardly in a relatively pointed manner, which is unfavorable since it increases the risk of blockages. On the other hand, the circumferential length of the foreign-body barrier should not be over-dimensioned and, in particular, it should be not more than 50% of the line circumference. This achieves a situation where, in comparison with a foreign-body barrier formed, for example, over the entire circumference, with the radial narrowing being the same, there is a greater clear cross-sectional area of the line at the location of the foreign-body barrier. This improves the correct operation of the vacuum toilet since, on account of the compressibility of feces material, in particular also the clear cross section, and not just the radial narrowing, is critical for said feces material to pass the foreign-body barrier.

The length of the foreign-body barrier in the flow direction is expediently from 0.2 times the line diameter to equal thereto, preferably approximately half the line diameter. On the one hand, the length of the foreign-body barrier in the flow direction should not be significantly greater than necessary, in order to avoid a pressure gradient being built up over the foreign-body barrier, as a result of which the operation of the feces being carried away by suction during operation could be obstructed. On the other hand, the length should not be too small, since this, in turn, increases the risk of blockages by the associated relatively pointed shape of the foreign-body barrier.

It is preferable for the shape of the foreign-body barrier to facilitate unobstructed passage by feces and tissues, toilet paper, hair and the like during normal operation. The foreign-body barrier does have slightly rounded shapes and is designed, in particular, without corners and edges. "Slightly rounded" here means that the radii of curvature of the foreign-body barrier which arise should not be significantly smaller than the pipeline radius. This shaping is advantageous, in particular, in the flow direction, and at that end of the foreign-body barrier which is directed towards the toilet bowl, in order to avoid the formation of protrusions. The preferred shape of the foreign-body barrier is thus a convexity which is oriented radially into the line interior.

The foreign-body barrier may be a separate part which is fixed to the inner pipe wall. However, it is expediently formed by an elastic deformation of the vacuum pipeline and/or of the insert pipe part, the deformation being directed into the line interior, with the result that a separate component and the corresponding fastening are dispensed with. The above-mentioned ideal convexity shape for the foreign-body barrier may be produced particularly straightforwardly by an approximately hemispherical or semi-elliptical counterpart with a radius corresponding approximately to the pipeline radius being pressed, during the production process of the vacuum pipeline and/or of the insert pipe part, into the still plastically deformable material from the outside. The insert pipe part and/or the pipeline thus expediently consist of plastic which allows the corresponding shaping in the production process and is cost-effective in addition.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
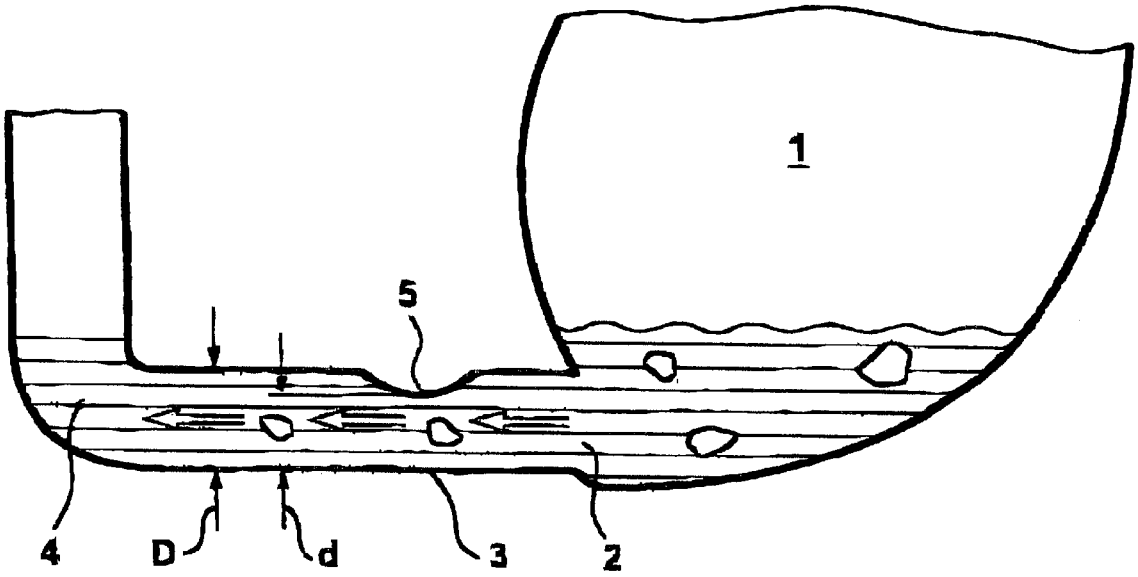
FIG. 1 is a schematic drawing of a vacuum toilet according to the invention.

The vacuum toilet comprises a toilet bowl 1 and a vacuum pipeline 3 which opens out into the toilet bowl at 2 and through which feces can be carried away from the toilet bowl by suction in the arrow direction (FIG. 1) following initiation of the vacuum-flushing mechanism. The arrow direction specifies the flow direction of the water which is carried away by suction. The radial direction is directed perpendicularly to the flow direction and to the pipe longitudinal axis, which is designated M in FIG. 3. The pipeline has a relatively sharp bend through approximately 90° at 4; "relatively sharp" here means that the radius of curvature of the bend is in the region of the line radius.

Located between the opening 2 and the bend 4, in the vicinity of the opening 2, is the foreign-body barrier 5, which is oriented radially into the interior of the line 3. The barrier 5 reduces the cross section of the pipeline 3, in the region of the greatest narrowing, to the smallest clear diameter d. Rigid cylindrical bodies with a diameter greater than d remain caught on the foreign-body barrier 5 and can be easily removed again from the line by way of the opening 2. The sharp bend 4 of the pipeline also prevents objects with a length of somewhat more than three times the pipeline diameter D from passing into the pipeline system, since they remain caught on the sharp bend 4. The bend 4 is also located in the vicinity of the opening 2 and is also accessible from the latter, with the result that jammed elongate objects are likewise accessible, and can be removed, from the opening 2.

Figure 2:
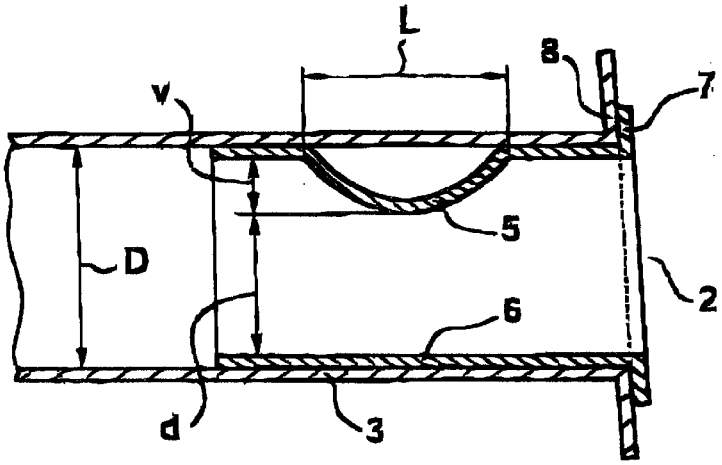
FIG. 2 is a longitudinal sectional view of part of a vacuum toilet in the region of the opening of the vacuum pipeline with an insert pipe part according to the invention inserted therein.
Figure 3:
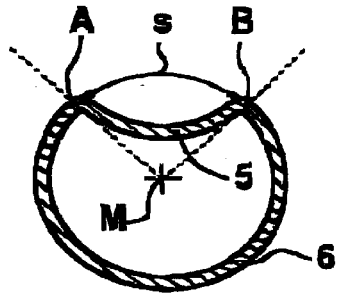
FIG. 3 is a cross section of an insert pipe part according to the invention level with the foreign-body barrier.
Figure 4:
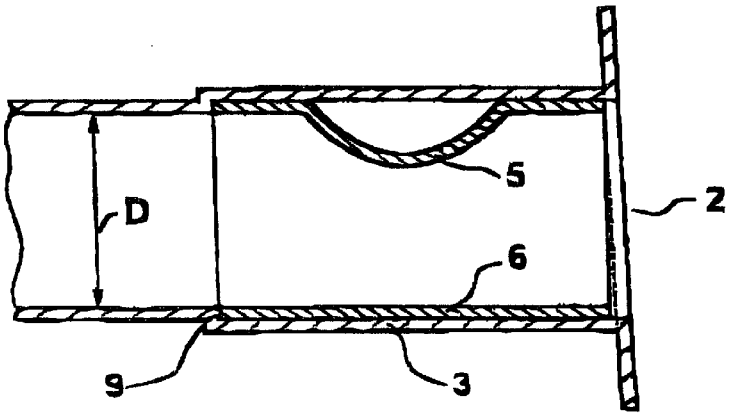
FIG. 4 is a longitudinal sectional view of an alternative arrangement of an insert pipe part according to the invention in the vacuum pipeline.

FIGS. 2 to 4 relate to the embodiment of the invention as an insert pipe part. The insert pipe part 6 is inserted into the vacuum pipeline 3 in the region of the opening 2. The pipe part 6 in this case is coordinated precisely with the pipeline 3, with the result that, for example in FIG. 2, the internal diameter of the insert part is only slightly smaller than the line diameter D; correct operation is thus not disrupted by the insert pipe part itself The foreign-body barrier, which is arranged in the interior of the insert pipe part, corresponds to that described above and acts in the same way. Rather than being a separate component fastened on the insert pipe part 6, the foreign-body barrier 5 is part of the insert pipe part itself and is produced from the same by a plastic deformation directed into the line interior.

Provided at one of the two pipe ends of the insert pipe part is the flange 7 which, in the operating state illustrated in FIG. 2, has its side which is directed towards the pipe part 6 resting on the opening edge 8 of the vacuum pipeline in the toilet bowl. On the one hand, the flange 7 prevents the insert part 6 from moving in the flow direction beyond the operating position, which is illustrated in FIG. 2. On the other hand, it is possible for the insert pipe part 6 to be removed freely from the vacuum line 3 in the direction counter to the flow direction, for example in order to remove foreign bodies or for cleaning purposes.

In order to remove the insert pipe part, use is expediently made of a tool which can be introduced into the pipeline 3 from the toilet bowl 1, by way of the opening 2, and engages behind the foreign-body barrier or the rear pipe end, whereupon it can be drawn out of the pipeline 3 together with the insert pipe part. Securing the insert pipe part 6 with the aid of a flange 7 is advantageous since, in order to remove the insert pipe part, there is no need to release any separate connection, and such removal is possible without any additional force being applied.

If the foreign-body barrier 5 is arranged in the immediate vicinity of the opening 2, i.e., at a distance from the opening which is smaller than the line diameter D, a foreign body which is to be kept out possibly projects into the toilet bowl 1 from the line and can be very easily gripped and removed, in particular without the insert pipe part, which may possibly be provided, having to be removed for this purpose.

In FIGS. 2 and 3 the dimensions and the shaping of the foreign-body barrier are illustrated more precisely. The cross-sectional narrowing v which is brought about by the foreign-body barrier 5 is approximately 30% of the line diameter D and is ideally adapted to the smallest clear cross section of the rest of the pipeline system (not shown in the figures). The length L of the foreign-body barrier in the flow direction is approximately equal to the line diameter D. As can be seen from FIG. 2, the foreign-body barrier is slightly rounded in the flow direction and is designed without corners and edges, with the result that the flow resistance is as low as possible.

In cross section (FIG. 3), the foreign-body barrier projects radially into the interior of the pipeline over a circumference region which is bounded by the points A and B and has the circumferential length s. This circumferential length s is preferably approximately 25% of the line circumference, with the result that the foreign-body barrier extends through an angle segment of approximately 90°. On account of their compressibility, feces which have a larger diameter than the narrowed cross-sectional diameter d can be pushed out, in particular into the regions adjacent to the points A and B and still pass the foreign-body barrier in this way, in contrast to rigid foreign bodies with diameters greater than d.

It can be seen by looking at FIGS. 2 and 3 together that the foreign-body barrier is in the form of a convexity which is oriented into the line interior, and the barrier is thus of slightly rounded design all the way round. This prevents even critical articles, such as hair, remaining caught, and also prevents the associated risk of blockage.

FIG. 4 shows an alternative arrangement of an insert pipe part in a corresponding vacuum pipeline. In the vicinity of its opening 2 into the toilet bowl 1, the pipeline 3 widens slightly in relation to the conventional pipeline diameter D, and this widening results in the formation of a stop edge 9 at the transition to the pipe diameter D. The insert pipe part 6 is provided for precisely fitting insertion into the widened part of the pipeline 3. The insert pipe part 6 thus strikes against the stop edge 9 of the pipeline by way of its end which is directed away from the toilet bowl; the stop 9 thus acts in the same way as the flange 7 explained with reference to FIG. 2. The amount by which the pipeline 3 widens corresponds to the wall thickness of the insert pipe part, with the result that, with a precise fit, a stepless transition from the inner surface of the insert pipe part 6 to the inner wall of the pipeline 3 is produced.

The embodiment shown in FIG. 4 has the advantage that it is possible to dispense with the flange 7 on the insert pipe part 6, which, in certain circumstances, has to be adapted to the conditions of different pipeline openings in toilet bowls. Although it is expedient for a stop 9 to be provided within the pipeline 3, in order to ensure that the insert pipe part is secured in a defined manner in the immediate vicinity of the opening 2, it is also conceivable to use an insert pipe part 6 of the shape which is shown in FIG. 4, i.e., without a retaining flange 7, in pipelines without an additional stop 9. The fit of the insert pipe part 6 is then defined by the beginning of the sharp bend 4, with the result that, in this arrangement too, the insert pipe part 6 is still accessible by way of the toilet bowl 1.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. In a vacuum toilet comprising a vacuum system, a toilet bowl (1) and a vacuum pipelines (3) having an opening (2) into the toilet bowl, the improvement comprising the vacuum pipeline (3) having a cross-sectional narrowing in a form of a foreign body barrier (5), wherein the foreign body barrier (5) comprises a rounded projection having a surface with a convex shape projecting radially from an interior wall of the pipeline (3) into the interior of the pipeline (3), the foreign body barrier (5) having sufficient lengths in both a flow direction and a circumferential direction of the pipeline (3) to avoid the surface of the rounded projection having a pointed shape, and the foreign body barrier (5) being arranged in a region of the opening (2) such that any foreign body caught on the barrier is easily accessible from and can be removed again by way of the opening (2) without having to dismantle the pipeline (3).

2. The vacuum toilet according to claim 1, wherein the cross-sectional narrowing brought about by the foreign-body barrier (5) is at least 10% of a pipeline diameter (D).

3. The vacuum toilet according to claim 1, wherein the cross-sectional narrowing which is brought about by the foreign-body barrier (5) is adapted approximately to a smallest clear cross section of a remainder of the pipeline system.

4. The vacuum toilet according to claim 1, wherein the length of the foreign-body barrier (5) in the circumferential direction is 10–50% of a circumference of the pipeline.

5. The vacuum toilet according to claim 1, wherein the length (L) of the foreign-body barrier (5) in the flow direction is from 0.2 times a pipeline diameter (D) to equal thereto.

6. The vacuum toilet according to claim 1, wherein the foreign-body barrier (5) is formed by a deformation of the vacuum pipeline (3), the deformation being directed into an interior of the pipeline.

7. The vacuum toilet according to claim 1, wherein the foreign body barrier (5) is arranged at a distance from the opening (2) which is smaller than a pipeline diameter (D).

8. The vacuum toilet according to claim 1, wherein the pipeline (3) is made of plastic.

9. The vacuum toilet according to claim 1, wherein the foreign body barrier (5) is formed without corners and edges.

10. The vacuum toilet according to claim 1, wherein the convex shape is approximately hemispherical or semi-elliptical.

11. An insert pipe part insertable into a vacuum pipeline (3) with an opening (2) into a toilet bowl (1) of a vacuum toilet in a region of the opening (2), the insert pipe part (6) comprising a cross-sectional narrowing in a form of a foreign-body barrier (5), wherein the foreign-body barrier comprises a rounded projection having a surface with a convex shape projecting radially from an interior wall of the insert pipe part (6) into the interior of the insert pipe part (6), the foreign body barrier (5) having sufficient lengths in both a flow direction and a circumferential direction of the insert pipe part (6) to avoid the surface of the rounded projection having a pointed shape.

12. The insert pipe part according to claim 11, wherein the length of the foreign body barrier (5) in the circumferential direction is 10%–50% of an inner circumference of the insert pipe part.

13. The insert pipe part according to claim 11, wherein the foreign body barrier (5) is formed by a deformation of the insert pipe part (6).

14. The insert pipe part according to claim 13, wherein the insert pipe part (6) is made of plastic.

15. The insert pipe part according to claim 11, further comprising a stop which prevents the insert pipe part (6) from moving in a flow direction into the vacuum pipeline (3) beyond a position in which it is inserted for operation.

16. The insert pipe part according to claim 15, wherein the stop comprises a flange (7) at one of two pipe ends and, in an operating state, the flange rests, by way of its side directed towards the pipe part, on an opening edge (8) of the vacuum pipeline (3) in the toilet bowl.

17. A method of preventing long-term blockage of a vacuum toilet system by a foreign body, comprising providing a cross-sectional narrowing which projects radially into a vacuum pipeline of the toilet system, the cross-sectional narrowing forming a foreign body barrier, wherein the foreign body barrier comprises a rounded projection having a surface with a convex shape projecting radially from an interior wall of the pipeline into the interior of the pipeline, the foreign body barrier having sufficient lengths in both a flew direction and a circumferential direction of the pipeline to avoid the surface of the rounded projection having a pointed shape, and the foreign body barrier being arranged in a region of the pipeline where the vacuum pipeline has an opening into a toilet bowl of the toilet system, such that any foreign body caught on the barrier is easily accessible from and can be removed again by way of the opening without having to dismantle the pipeline.

18. The method according to claim 17, wherein the cross-sectional narrowing is provided by plastic deformation of the vacuum pipeline itself.

19. The method according to claim 17, wherein the cross-sectional narrowing is provided by inserting into the vacuum pipeline an insert pipe part having the cross-sectional narrowing projecting radially into an interior of the pipeline.

20. The method according to claim 19, wherein the insert pipe part is retrofitted into an existing vacuum toilet system by inserting the insert pipe part into a region of the opening of the vacuum pipeline.

* * * * *